United States Patent [19]

Erickson

[11] 4,057,123

[45] Nov. 8, 1977

[54] LIGHTWEIGHT SOUND ABSORBENT PANELS HAVING HIGH NOISE REDUCTION COEFFICIENT

[75] Inventor: Gordon A. Erickson, St. Paul, Minn.

[73] Assignee: Conwed Corporation, St. Paul, Minn.

[21] Appl. No.: 637,415

[22] Filed: Dec. 3, 1975

[51] Int. Cl.[2] ..... E04B 2/74

[52] U.S. Cl. ..... 181/286; 52/239; 160/351; 181/287; 181/290; 181/295

[58] Field of Search ..... 181/33 G, 30, 33 GB, 181/33 GD; 52/239, 145, 575; 160/135, 351

[56] References Cited

U.S. PATENT DOCUMENTS

| | | | |
|---|---|---|---|
| 1,703,011 | 2/1929 | Mazer | 181/33 G |
| 2,085,436 | 6/1937 | Maurer | 181/33 G |
| 2,116,270 | 5/1938 | LeGrand | 181/33 G |
| 2,177,393 | 10/1939 | Parkinson | 181/33 G |
| 3,159,235 | 12/1964 | Young et al. | 181/33 G |
| 3,713,474 | 1/1973 | Orlando | 160/351 |
| 3,713,508 | 1/1973 | Eckel | 181/33 G |
| 3,949,827 | 4/1976 | Witherspoon | 181/33 GB |

*Primary Examiner*—Lawrence R. Franklin
*Attorney, Agent, or Firm*—Eyre, Mann, Lucas & Just

[57] ABSTRACT

A lightweight sound absorbing panel is disclosed. The panel comprises front and rear faces mounted to a supporting frame and having a core therebetween. The core is at least partially free airspace throughout a substantial portion of the area of the panel whereby weight reduction and increased sound absorption are obtained.

8 Claims, 5 Drawing Figures

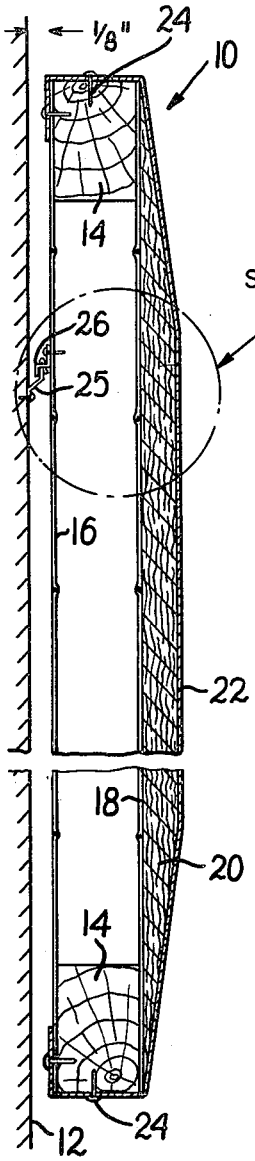
FIG. 1
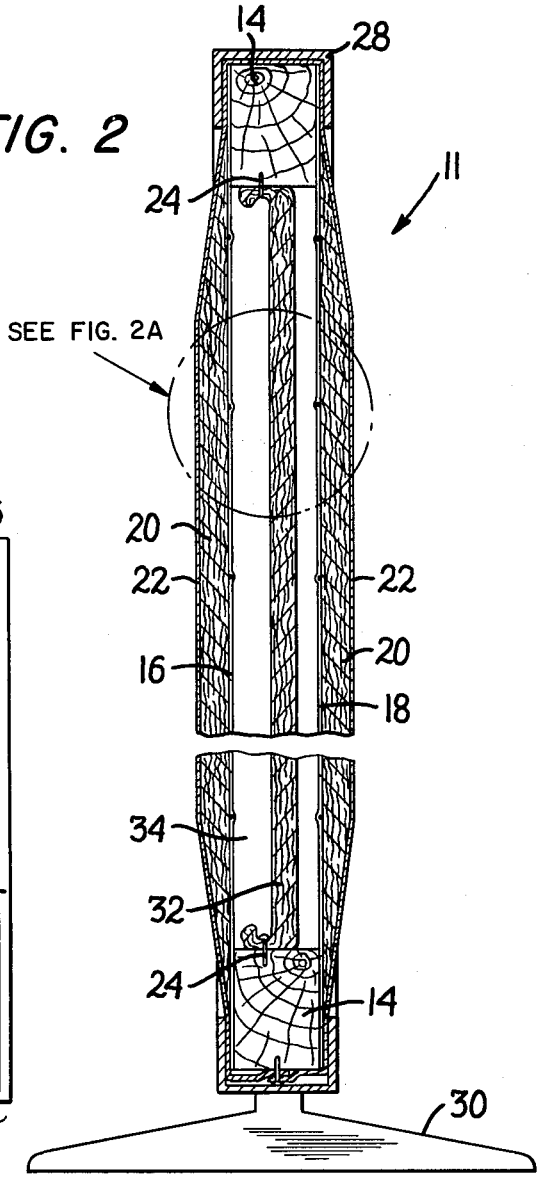
FIG. 2
FIG. 3
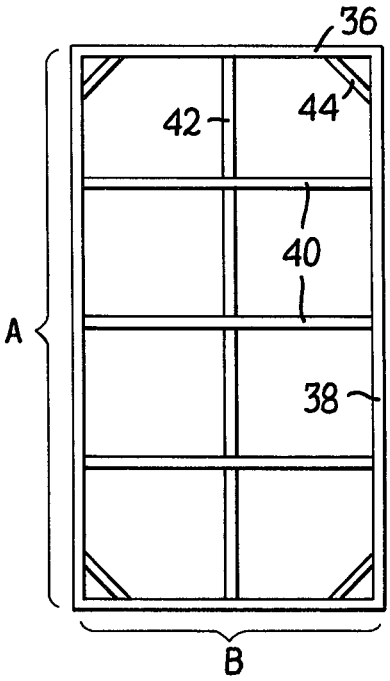
FIG. 1A
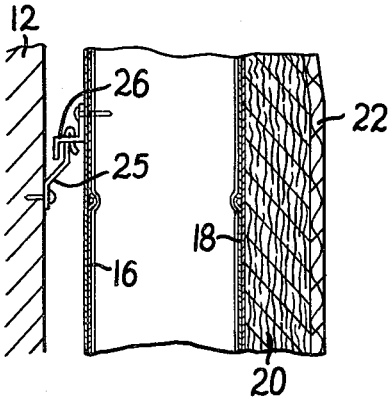
FIG. 2A
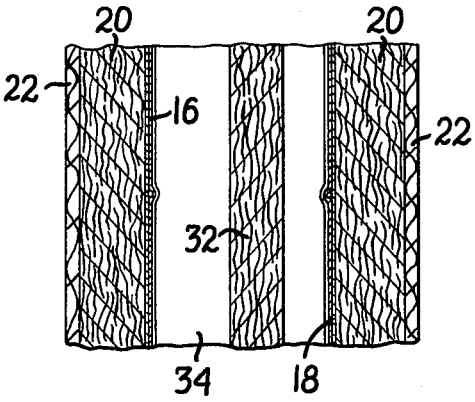

LIGHTWEIGHT SOUND ABSORBENT PANELS HAVING HIGH NOISE REDUCTION COEFFICIENT

The present invention relates to sound absorbing panels and more particularly to a new and improved form of sound absorbing panel which is not only lightweight but is also highly absorbent of sound. The panel can be constructed to a Class 1 fire rating and still obtain it highly desirable properties.

Sound absorbent panels for use on walls or as freestanding dividers have been known for a number of years. It has generally been thought that the more sound absorbent material present in a sound absorbing panel, the better the sound absorption. This has necessarily meant that an increase in sound absorption is accompanied by an increase in weight of the sound absorbing panel.

The applicant has surprisingly found that a sound absorbing panel can be constructed and have high sound absorption purposes while still being of relatively light weight. The essential feature of a sound absorbing panel according to the present invention is a free airspace in the core of the panel, the free airspace being present substantially throughout the area of the panel.

These and other features of the present invention may be more fully understood by reference to the accompanying drawings in which:

FIG. 1 shows a side cross-sectional view of one embodiment of a panel according to the present invention suitable for mounting on a wall;

FIG. 1A is an enlarged view of the portion within the circle in FIG. 1;

FIG. 2 shows a side cross-sectional view of an embodiment of the invention suitable for use as a freestanding member;

FIG. 2A is an enlarged view of the portion within the circle in FIG. 2; and

FIG. 3 shows a front cross-sectional view of a panel according to the present invention.

FIG. 1 shows a sound panel 10 in accordance with the present invention mounted on a wall 12. The sound absorbing panel comprises frame members 14 having a foil laminate 16, 18 affixed to each face thereof. The foil laminate comprises a metal foil such as aluminum affixed to a substrate such as kraft paper, cloth or the like. The foil laminate may also suitably include reinforcing material such as fiberglass strands to produce a stronger structure. The purpose for using a foil backed laminate is to improve the fire rating of the composite structure. Laminate may also be double fire resistent kraft with reinforcement between. In either case the laminates may be perforated if desired. These materials are very well known in the art. The primary purpose of the members 16, 18 is to provide support for the central portion of the structure while still being lightweight and of acceptable fire rating. Where fire rating and/or strength is not critical, members 16, 18 can be replaced by another type of sheet material, e.g., plain kraft paper, polyethylene film, wire mesh or the like.

On the face of the foil laminate 18 is mounted a sound absorbing material 20. For lightness, fire rating and good sound absorbing properties, this material is preferably a glass fiber blanket having a density of from about ½ pound to about three pounds per cubic foot. A typical sound absorbing material will comprise two sheets of ½ inch thick glass fiber sheets having a density between ½ pound and one pound. It is not necessary for the insulation material 20 to be affixed to the foil laminate 18 but it may be glued or stapled thereto if desired. On the face of the insulating material 20 is an outer layer 22, this layer having primarily decorative effect. Where fire rating is important, fabrics such as woven fiberglass or chemically treated polyesters are preferred. Other suitable covering materials include burlap, acrylics, nylons, textiles, and the like.

If the sound absorbent panel is likely to encounter high humidity, heavy dusting or other soil producing conditions, the cover layer may be of an impervious material such as polyethylene or vinyl from about 2 mils to about 20 mils in thickness. While this will substantially reduce the noise reduction coefficient of the sound absorbent panel, there will still be obtained a significant amount of noise reduction. However, if maximum noise reduction is required, the face member 22 should be sound permeable.

Between the members 16, 18 is a void space. This void space is substantially throughout the area of the panel and has been found to benefit noise reduction. While it was previously believed that this void space should be filled in with sound absorbing material, it has been found that such is not the case and that a void will actually result in greater sound reduction. The thickness of this void space should be at least about ¼ inch and it is preferable that it be at least about ½ inch.

All of the components 16, 18, 20 and 22 are affixed to the frame 14 by staples 24. For ease of construction, it has been found that staples or staple-like members which penetrate the frame 14 and affix themselves without additional steps are highly desirable. The staples 24 may enter through back or top as shown and it will be understood that the staple-like members 24 may be used to affix each successive layer to the frame member or may affix two or more layers simultaneously. It will be apparent to those skilled in the art that, while somewhat less desirable, thumbtack-like members may also be employed and that either staples or thumbtacks or the like may have roughened edges for greater holding power.

In order to receive the staple-like members, it is necessary that the frame 14 be capable of being penetrated thereby. While this can suitably be accomplished with a wooden frame, it will be appreciated that in some instances, especially high humidity, a wood frame is not desirable because of swelling, warping and the like. In these instances, a metal frame such as of aluminum or steel or a plastic frame such as a phenolic or polycarbonate can be substituted for the wood. However, staple receiving means should be included, e.g., a strip of wood or other staple penetrable material may be inserted in a groove in the frame member where staples are desired to be used. Alternatively, if the wood frame is used it can be reinforced against warping as for example by the use of T-bars in the edges thereof.

The panel 10 is mounted to the wall 12 suitably by bracket member 25 mounted on the wall corresponding with bracket 26 of the panel. It is preferred that the bracket members be constructed so that the panel will be spaced at least about ⅛ inch from the wall 12. It has been found that this particular mounting aids in sound absorption.

The embodiment of FIG. 2 is quite similar to the embodiment of FIG. 1 except that in this instance the panel is designed to be freestanding rather than mounted on a wall. The panel again comprises frame members 14, foil laminate members 16, 18, sound absorption material 20 and covering material 22. In this instance, the sound absorbent material and the cover material are placed on both faces of the panel rather than on a single face as with the wall mounted member. While the wall mounted member could have the sound absorbent material 20 and the covering material 22 on both faces thereof, it has been found that this does not materially enhance sound absorbing properties and is somewhat detrimental both in terms of cost and weight.

Referring again to FIG. 2, the freestanding panel further comprises a U-shaped channel member 28 which surrounds the panel 11 and is affixed to a base member 30 to enable the panel to be freestanding.

It will be noted that between the laminate members 16, 18 there is present a fiberglass batt 32 and that the space between the members 16, 18 is not void as in FIG. 1. It has been found that this additional batt, so long as it does not occupy all of the free space between the members 16, 18 helps to increase sound absorption which, of course, is done at the expense of increased weight and cost. As set forth above, the essential requirement is that there be at least about ¼ inch of free space throughout substantially all of the area of the panel and this is present in the embodiment of FIG. 2 as shown by reference designator 34.

FIG. 3 shows a typical frame layout for a panel of nominal 4 foot by 8 foot size. It will be understood that in smaller sizes or where structural strength is not required, only members 36 and 38 are required. However, for larger members or for greater strength, one or more cross pieces 40 and one or more vertical pieces 42 are preferably also included as well as corner reinforcing members 44.

When speaking of the void portion of the panel in terms of the area of the panel, the area of the panel is intended to mean distance A times distance B of FIG. 3. The use of the term "substantially all of the area" is to allow for the presence of cross members such as 40 and 42 and also to avoid the possibility of a potential infringer filling in completely a small part of the void area and arguing that this avoids infringement.

The sound absorbing panels of the present invention have a noise reduction coefficient as high as 0.88 and the construction has a fire rating of Class 1 according to ASTM Test No. C-423-66 in most instances. The exceptions to the attaining of the Class 1 fire rating have been noted hereinabove.

It will be understood that the claims are intended to cover all changes and modifications of the preferred embodiments of the invention, herein chosen for the purpose of illustration, which do not constitute departures from the spirit and scope of the invention.

What is claimed is:

1. A portable sound absorbing panel which has a fire rating of Class 1 according to ASTM Test No. C-423-66 comprising:

a. a frame comprising a plurality of framing members capable of receiving staples, said frame defining an area and said frame having front and rear faces;

b. a layer of sheet material affixed to said front and rear faces of said frame and defining a volume therebetween, said sheet material being a fire resistant laminate;

c. at least one layer of sound absorbing material positioned on one of said faces atop said layer of sheet material said sound absorbing material being a glass fiber blanket having a density of from about ½ to about 3 pounds per cubic foot;

d. a covering material on top of the said sound absorbing material said covering material being selected from the group consisting of woven fiberglass and polyesters which have been chemically treated for fire retardancy;

e. said volume being at least about ¼ inch in thickness throughout a substantial portion of said area of said frame.

2. The sound absorbing panel of claim 1 wherein sound absorbing material is present on both faces of said frame.

3. The sound panel of claim 1 wherein covering material is present on both faces of said frame.

4. The sound absorbing panel of claim 1 further including sound absorbent material in said volume.

5. The sound absorbing panel of claim 1 wherein said sheet material comprises aluminum foil, kraft paper and reinforcing material therebetween.

6. The sound absorbing panel of claim 1 wherein at least some of said layers are affixed to said frame with staple-like members.

7. The sound absorbing panel of claim 1 further comprising means enabling said panel to be freestanding.

8. The sound absorbing panel of claim 1 wherein said panel is adapted to be mounted on a wall and further including mounting means adapted to space said panel at least about ⅛ inch from a wall.

* * * * *

UNITED STATES PATENT AND TRADEMARK OFFICE

CERTIFICATE OF CORRECTION

PATENT NO. : 4,057,123
DATED : November 8, 1977
INVENTOR(S) : Gordon A. Erickson It is certified that error appears in the above-identified patent and that said Letters Patent are hereby corrected as shown below:

Column 1, line 42, after "sound" --absorbing-- was omitted.

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*